United States Patent [19]

Cook

[11] Patent Number: 5,056,845

[45] Date of Patent: Oct. 15, 1991

[54] MATERIAL MANIPULATION APPARATUS

[76] Inventor: Carol A. Cook, 614 State St., Hanson, Mass. 02341

[21] Appl. No.: 550,068

[22] Filed: Jul. 9, 1990

[51] Int. Cl.[5] ..... B66C 1/44

[52] U.S. Cl. ..... 294/118; 294/902

[58] Field of Search ..... 294/62, 63.1, 65, 67.31, 294/81.61, 86.4, 88, 99.1, 106, 111–113, 110.1, 115–119

[56] References Cited

U.S. PATENT DOCUMENTS

| | | | |
|---|---|---|---|
| 580,558 | 4/1897 | Scott | 294/117 |
| 2,337,177 | 12/1943 | Breslav | 294/118 |
| 2,586,843 | 2/1952 | McDonald | 294/118 X |
| 4,169,622 | 10/1979 | Claassen et al. | 294/118 |
| 4,175,903 | 11/1979 | Carson | 294/88 X |
| 4,452,481 | 6/1984 | Williams | 294/118 |
| 4,543,032 | 9/1985 | Leverett et al. | 294/86.4 X |
| 4,545,609 | 10/1985 | Pasquazzi et al. | 294/106 X |

FOREIGN PATENT DOCUMENTS

| | | | |
|---|---|---|---|
| 1185260 | 7/1959 | France | 294/118 |
| 400022 | 4/1966 | Switzerland | 294/118 |

*Primary Examiner*—Johnny D. Cherry
*Attorney, Agent, or Firm*—Leon Gilden

[57] ABSTRACT

An apparatus including pivoted arms relatively movable together, including a first arm and a second arm and a pivot axle positioned to secure each arm in a cross pivoted configuration, wherein the first arm includes a first jaw and the second arm includes a second jaw, each formed with a resilient face. Each arm includes an upper respective first and second link, each pivoted rearwardly to each respective first and second arm and pivoted at their forward terminal ends relative to one another securing a support ring, with the support ring including support linkage mounting the arms to a lifting member. The arms include medial linkage, including a third and fourth link to align the linkage relative to one another, with the third link including an abutment flange to prevent over-centering of the third link relative to the fourth link. The jaws are formed with replaceable faces including a "C" shaped jaw support slidably receiving a support web mounted at a lower terminal end of each arm.

1 Claim, 4 Drawing Sheets

MATERIAL MANIPULATION APPARATUS

BACKGROUND OF THE INVENTION

1. Field of the Invention

The field of invention relates to material support apparatus, and more particularly pertains to a new and improved material manipulation apparatus wherein the same permits grasping and manipulation of various construction components such as highway dividers.

2. Description of the Prior Art

Article manipulation apparatus of various types are known throughout the prior art to permit manipulation of various components. Particularly in highway construction, highway dividers are of a relatively awkward configuration and typically require cables and the like mounted thereto to permit their positioning relative to an associated highway. Examples of such divider organizations may be found in U.S. Pat. No. 4,663,332 to Burgett illustrating the use of cables and links mounted to the highway dividers to manipulate the highway dividers to an operative association into a working environment, such as a highway.

U.S. Pat. No. 4,017,200 to Woods, Jr. sets forth highway divider apparatus utilizing a tow vehicle to tow such organizations into operative association on an associated highway.

U.S. Pat. No. 4,498,803 to Quittner illustrates the use of barrier apparatus including locking members to lock the barriers together in use.

U.S. Pat. No. 4,500,225 to Quittner illustrates further highway dividers and organizations to secure them in an operative association relative to one another.

As such, it may be appreciated that there continues to be a need for a new and improved material manipulation apparatus wherein the same permits ease of manipulation of highway apparatus and the like for use in a highway scenario and as such, the present invention substantially fulfills this need.

SUMMARY OF THE INVENTION

In view of the foregoing disadvantages inherent in the known types of grappling apparatus now present in the prior art, the present invention provides a material manipulation apparatus wherein the same utilizes resilient jaw faces to frictionally and positively engage opposed surfaces of highway divider members and the like for manipulation of such dividers into operative association with a highway structure. As such, the general purpose of the present invention, which will be described subsequently in greater detail, is to provide a new and improved material manipulation apparatus which has all the advantages of the prior art material grasping devices and none of the disadvantages.

To attain this, the present invention provides an apparatus including pivoted arms relatively movable together, including a first arm and a second arm and a pivot axle positioned to secure each arm in a cross pivoted configuration, wherein the first arm includes a first jaw and the second arm includes a second jaw, each formed with a resilient face. Each arm includes an upper respective first and second link, each pivoted rearwardly to each respective first and second arm and pivoted at their forward terminal ends relative to one another securing a support ring, with the support ring including support linkage mounting the arms to a lifting member. The arms include medial linkage, including a third and fourth link to align the linkage relative to one another, with the third link including an abutment flange to prevent over-centering of the third link relative to the fourth link. The jaws are formed with replaceable faces including a "C" shaped jaw support slidably receiving a support web mounted at a lower terminal end of each arm.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved material manipulation apparatus which has all the advantages of the prior art material grasping devices and none of the disadvantages.

It is another object of the present invention to provide a new and improved material manipulation apparatus which may be easily and efficiently manufactured and marketed.

It is a further object of the present invention to provide a new and improved material manipulation apparatus which is of a durable and reliable construction.

An even further object of the present invention is to provide a new and improved material manipulation apparatus which is susceptible of a low cost of manufacture with regard to both materials and labor, and which accordingly is then susceptible of low prices of sale to the consuming public, thereby making such material manipulation apparatus economically available to the buying public.

Still yet another object of the present invention is to provide a new and improved material manipulation apparatus which provides in the apparatuses and methods of the prior art some of the advantages thereof, while simultaneously overcoming some of the disadvantages normally associated therewith.

Still another object of the present invention is to provide a new and improved material manipulation apparatus wherein the same accommodates various highway dividers, particularly dividers utilizing sloped jaw faces to permit resilient grasping of such dividers to minimize destruction of such dividers, while simultaneously permitting ease of manipulation and positioning of such dividers in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
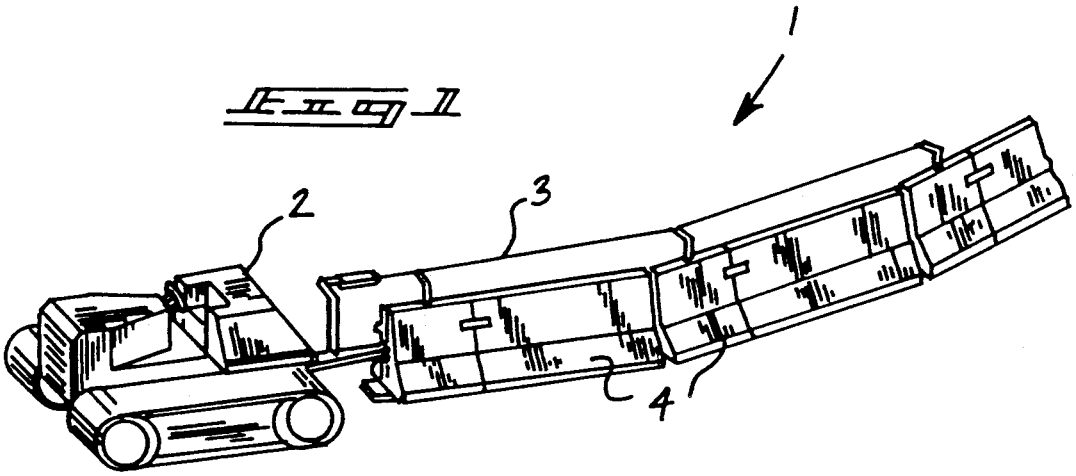
FIG. 1 is an isometric illustration of a prior art highway divider manipulation apparatus.

With reference now to the drawings, and in particular to FIGS. 1 to 8 thereof, a new and improved material manipulation apparatus embodying the principles and concepts of the present invention and generally designated by the reference numeral 10 will be described.

FIG. 1 illustrates a prior art manipulation apparatus 1, wherein a tow vehicle 2 utilizes cables 3 to permit securement to associated highway dividers 4 to permit towing of such dividers into a desired operative association within existing highway structure.

More specifically, the material manipulation apparatus 10 of the instant invention essentially comprises a lift member 11 including lifting arms 12 mounted integrally thereto to effect vertical lifting of the lift member 11. A support mount 14 is mounted to the lift member 11. A support ring 13 is positioned underlying the support mount 14 and associated support mount by an intermediate support link **14*a* utilizing a pin 14*b*** to secure the support ring to the support mount.

Figure 2:
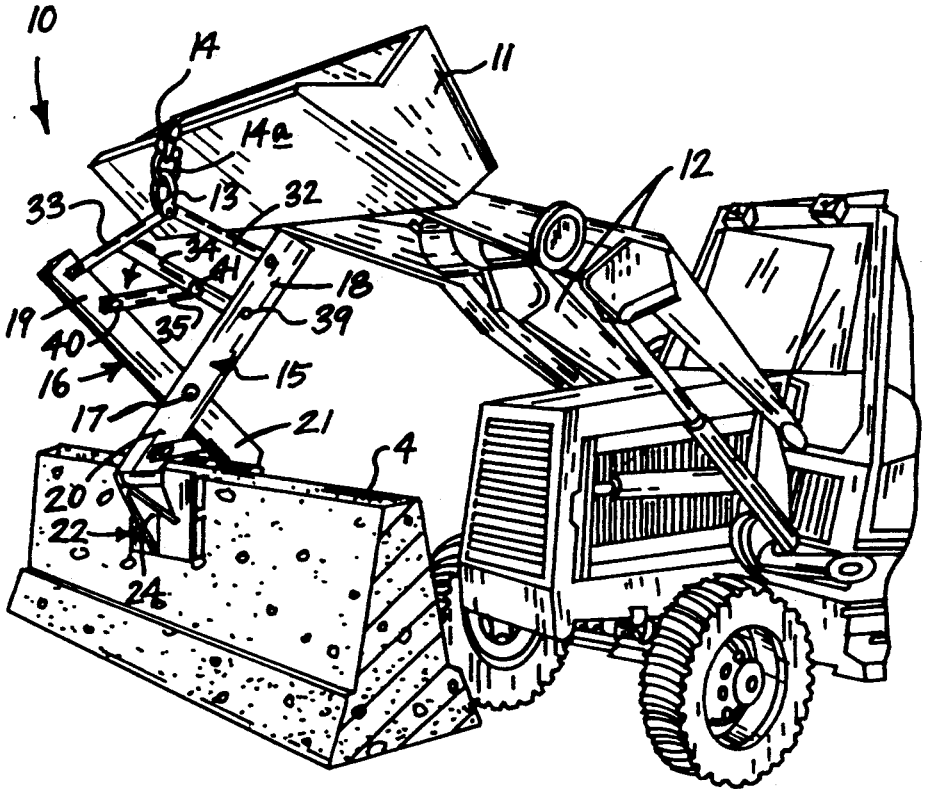
PRIOR ART FIG 2
FIG. 2 is an isometric illustration of the instant invention.

A first arm 15 is pivotally mounted to a second arm 16 at a first pivot axle 17, wherein the first pivot axle 17 is positioned approximately two-thirds to three-fourths of a predetermined length between the upper and lower terminal ends of the respective first and second arms. The first arm 15 is divided into an upper first arm 18 and a lower first arm 20 above and below the respective first pivot axle 17, wherein the second arm 16 is divided into an upper second arm 19 and a lower second arm 21 above and below the first pivot axle 17. The lower first arm 20 includes a first jaw 22 mounted to the lower first arm 20 by first arm webs 24 arranged at an acute angle to the lower first arm 20 (see FIG. 3). The second jaw 23 is mounted to the lower second arm 21 by second jaw arm webs 25, also arranged at an acute angle to the lower second arm 21, wherein the first and second jaws 22 and 23, respectively, are arranged in confronting relationship relative to one another. Each first and second jaw 22 and 23 includes a corresponding respective first and second jaw support web 26 and 27, each of a predetermined height. For purposes of illustrations, the first jaw and associated first jaw web 26 are illustrated in FIG. 4, where it is understood that each respective jaw and jaw web are of identical configuration. The first jaw includes a first resilient jaw grasping member 28, with a corresponding second resilient jaw grasping member 29 mounted to the second jaw 23, wherein the first and second resilient members 28 and 29 are in confronting relationship to engage opposed sides of an associated construction or median member 4, as illustrated in FIG. 2. Each jaw, including the first and second jaws 22 and 23, includes a first and second jaw safety bar 30 and 31 mounted overlying medially each jaw 22 and 23 and directed orthogonally relative to the respective first and second jaw support webs 26 and 27 to prevent complete closure of the first and second confronting jaws together preventing inadvertent injury to individuals and the like positioning a portion of the individual between the respective confronting jaws.

A first link 32 is mounted at its rear terminal end by a first link rear pivot 37 adjacent an upper terminal end of the upper first arm 18. A second link 33 is pivotally mounted at its rear terminal end to a second link rear pivot 38 adjacent the upper terminal end of the upper second arm 19. The first and second links 32 and 33 are pivotally mounted intermediate their forward terminal ends by a second pivot 36, wherein the second pivot 36 is integrally associated with the support ring 13 to effect lifting and scissored closure of the respective first and second jaws 22 and 23 upon lifting by the lift member 11. A third link 34 and a fourth link 35 are pivotally mounted to respective first and second arms 18 and 19 at rear terminal ends of the respective third and fourth links at a third link rear pivot 39 and a respective fourth link rear pivot 40. The fourth link 35 is pivotally mounted intermediate the third link 34 at a third pivot 41. The third and fourth links are mounted medially of the first and second links 32 and the first pivot axle 17.

Figure 3:
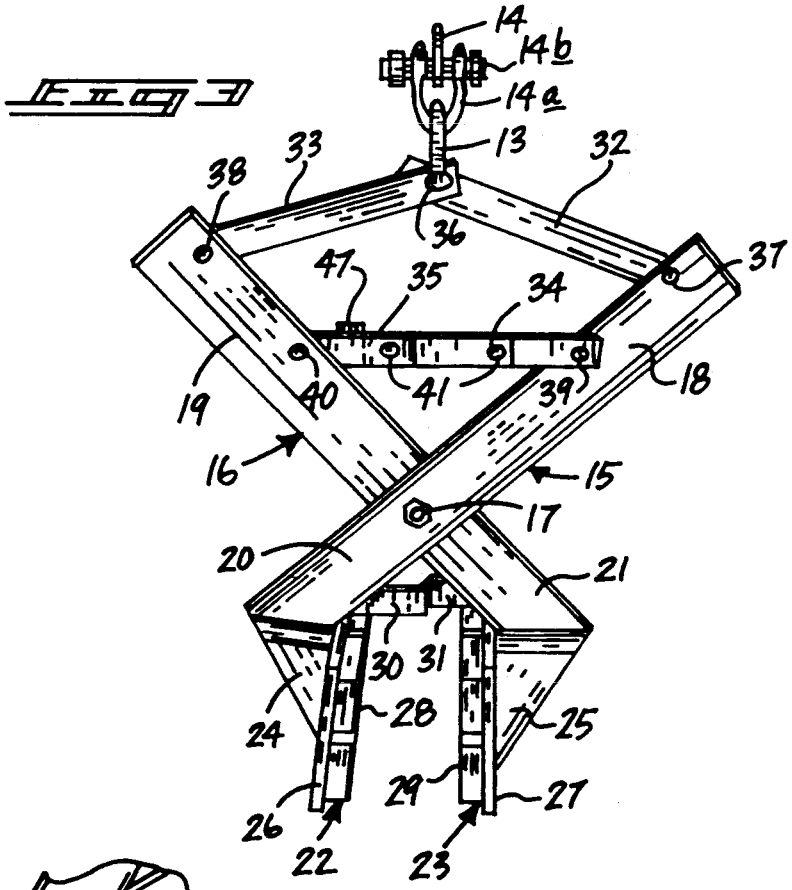
FIG. 3 is an orthographic side view, taken in elevation, of the instant invention.
Figure 4:
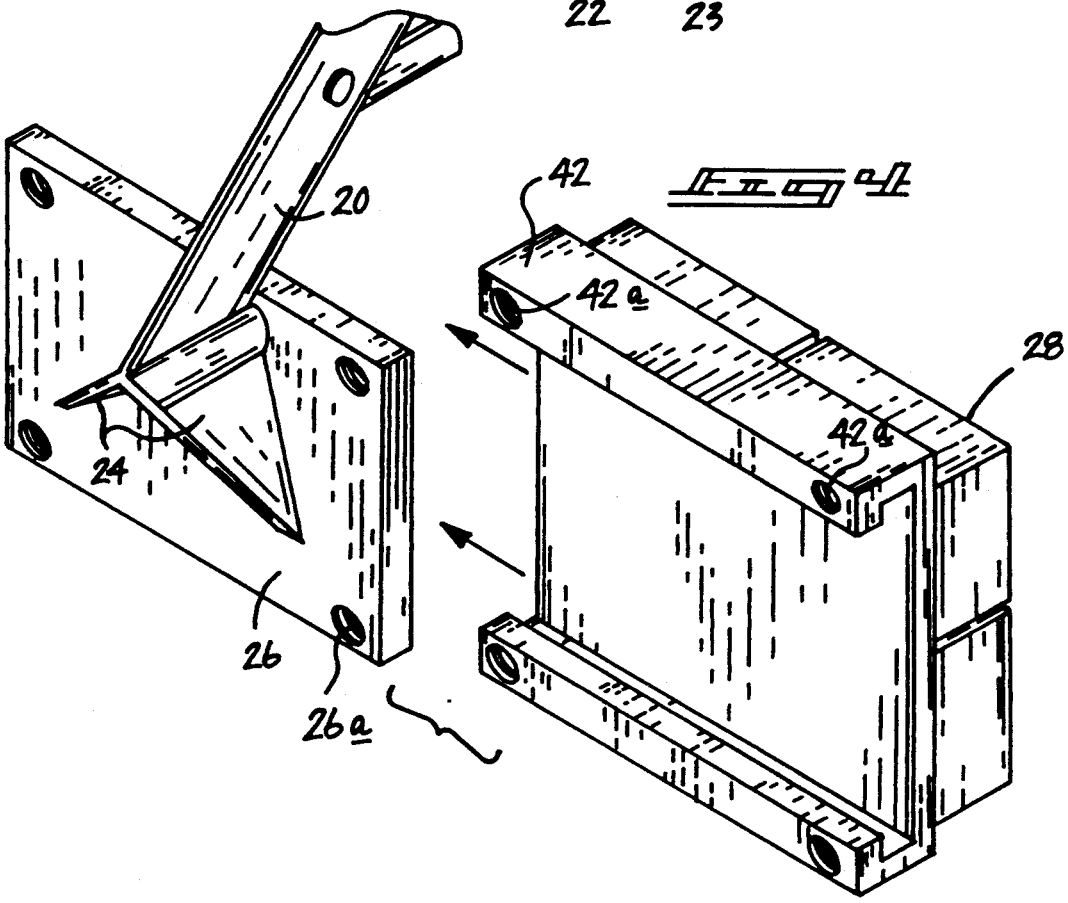
FIG. 4 is an isometric illustration of a jaw structure utilized by the instant invention.

An abutment flange 47 integrally mounted adjacent a forward terminal end of the third link 34 at an upper edge thereof prevents over-centering of the third and fourth links together, whereupon alignment of the third and fourth links in an open orientation of the jaws 22 and 23 is maintained by the abutment flange 47, as illustrated in FIG. 3.

FIG. 4 illustrates a typical construction of each of the first and second jaws 22 and 23, wherein the first jaw 22 with the first support web 26 defined by the predetermined height is slidably received within a "C" shaped jaw support 42, including spaced upper and lower "L" shaped arms spaced apart a predetermined height equal to the predetermined height of the first support web 26 to complementarily receive the first support web 26 within the "C" shaped jaw support 42. Threaded first support web apertures **26*a* and threaded "C" shaped jaw support apertures 42*a* are in alignment relative to one another when the first jaw support web 26 is received within the "C" shaped jaw support 42**. Threaded fasteners (not shown) of conventional construction are thereafter directed through the threaded apertures to secure the first jaw in a fixed orientation. This permits use of a variety of jaws by the instant invention to accommodate construction members of various contours and surface characteristics.

Figure 5:
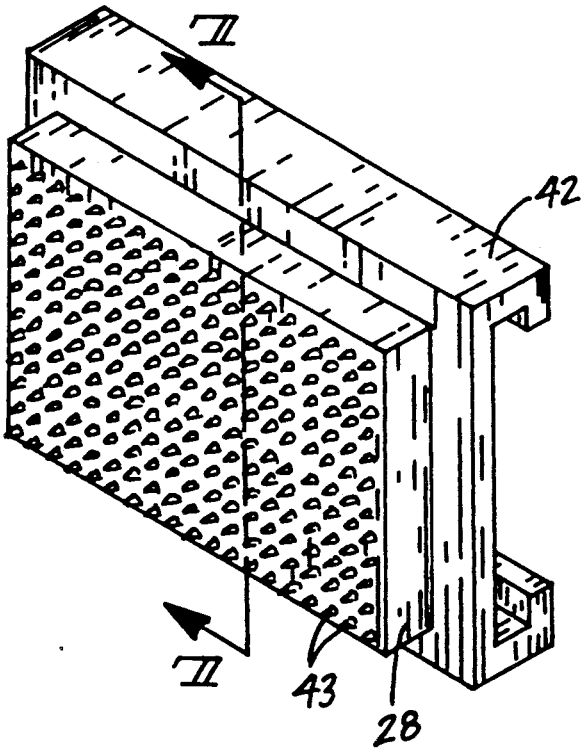
FIG. 5 is an isometric forward illustration of a modified jaw face structure of the instant invention.
Figure 6:
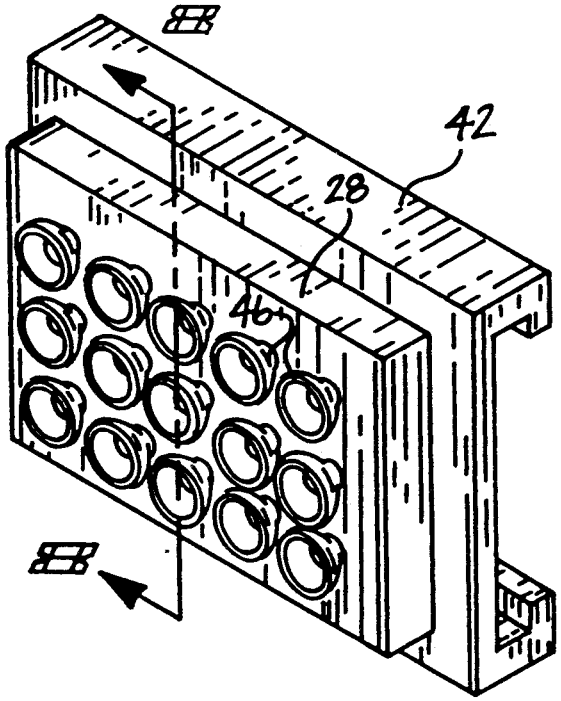
FIG. 6 is an isometric illustration of a yet further modified jaw structure of the instant invention.
Figure 7:
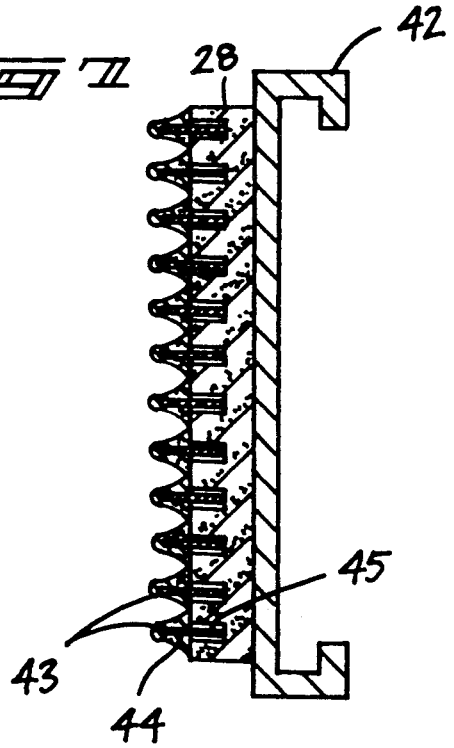
FIG. 7 is an orthographic view, taken along the lines 7—7 of FIG. 5, in the direction indicated by the arrows.
Figure 8:
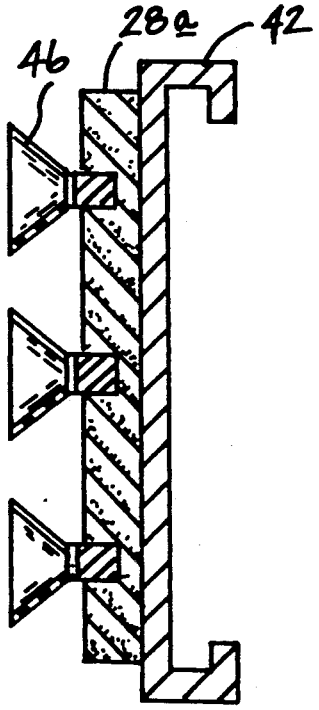
FIG. 8 is an orthographic view, taken along the lines 8—8 of FIG. 6, in the direction indicated by the arrows.

For example, FIG. 5 illustrates a jaw structure wherein the "C" shaped jaw support 42 mounts a resilient grasping member 28, wherein resilient projections 43 are threadedly mounted orthogonally relative to a forward face of the resilient grasping member 28, wherein the matrix of resilient projections 43 each include an encased threaded support shank 44 that is threadedly received within a threaded bore 45 orthogonally directed within the first resilient grasping member 28. Accordingly, such resilient projections 43 in a matrix directed coextensively with the forward surface of the second resilient jaw grasping member 29 may also be employed to enhance grasping of an object therebetween. Alternatively, a further "C" shaped jaw support 42 may includes a matrix of suction cups 46 mounted within the resilient grasping member 28 to enhance grasping of various objects, such as glass, plastics, and the like defined by a relatively smooth, non-porous surface structure.

As to the manner of usage and operation of the instant invention, the same should be apparent from the above disclosure, and, accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A material manipulation apparatus comprising, in combination, a first arm mounted to a second arm, including a first pivot axle pivotally mounting the first arm to the second arm in a cross configuration, wherein the first pivot axle divides the first arm as an upper first arm and a lower first arm and divides the second arm into an upper second arm and a lower second arm, and the lower first arm includes a first jaw arm web arranged at an acute angle to the lower first arm at a lower terminal end thereof mounting a first jaw, and the lower terminal end of the lower second arm includes second jaw arm webs arranged at an acute angle to the lower second arm mounting a second jaw, the first and second jaws arranged in confronting relationship relative to one another, and a first link mounted adjacent an upper terminal end of the upper first arm, including a first link rear pivot mounting a rear terminal end of the first link to the upper first arm, the first link including a first link forward terminal end, and a second link, including a second link forward terminal end and a second link rear terminal end, and a second link rear pivot mounting the second arm rear terminal end to the upper second arm, and the first link and the second link pivotally mounted together, including a second pivot directed adjacent the forward terminal ends of the first link and the second link, and wherein the second pivot includes a support ring fixedly mounted thereto, and the support ring including a support link, the support link including a lock pin to selectively secure the support link to a support mount, the support mount fixedly mounted to a lift member to effect lifting and simultaneous closure of the first jaw relative to the second jaw, and wherein the upper first arm includes a third link, including a third link rear pivot directed through the third link adjacent a rear terminal end of the third link and through the upper first arm between the first link rear pivot and the first pivot axle, and a fourth link, including a fourth link rear terminal end and a fourth link forward terminal end, with the fourth link rear terminal end mounted to the upper second arm intermediate the second link rear pivot and the first pivot axle, and the forward terminal end of the fourth link including a third pivot directed intermediate the third link to pivotally secure the fourth link to the third link, and wherein the third link includes an abutment flange fixedly mounted to the third link adjacent a forward terminal end of the third link to prevent overcentering of the third link relative to the fourth link, and wherein the third link is defined by a predetermined length, and wherein the fourth link is defined by a fourth link length less than the predetermined length, and wherein the first jaw includes a first jaw support web defined by a predetermined height, and the first jaw support web complementarily received within a "C" shaped jaw support, the "C" shaped jaw support defined by spaced flanges spaced apart the predetermined height, and the second jaw includes a second jaw support web defined by the predetermined height, the second jaw support web complementarily received within a "C" shaped jaw support, wherein the first and second jaw support webs are fixedly secured to the respective first and second jaw arm webs, and wherein each of the first and second jaws include a resilient first jaw grasping member and a respective second resilient jaw grasping member, and wherein the jaw grasping members each include resilient projections mounted orthogonally and outwardly of each forward surface of each grasping member, and each resilient projection defines a matrix of projections coextensively formed about the forward surface of each grasping member, and each resilient projection includes a threaded support shank, each threaded support shank threadedly received within a threaded bore formed within each grasping member.

* * * * *